United States Patent [19]

Matsuoka et al.

[11] Patent Number: 4,829,777

[45] Date of Patent: May 16, 1989

[54] REFRIGERATION SYSTEM

[75] Inventors: Akio Matsuoka, Oobu; Yuuji Honda; Masashi Takagi, both of Kariya, all of Japan

[73] Assignee: Nippondenso Co., Ltd., Kariya, Japan

[21] Appl. No.: 74,996

[22] Filed: Jul. 14, 1987

[30] Foreign Application Priority Data

Jul. 23, 1986 [JP] Japan ..... 61-173306
Nov. 28, 1986 [JP] Japan ..... 61-283520
Mar. 26, 1987 [JP] Japan ..... 62-72854

[51] Int. Cl.[4] ..... F25B 41/00

[52] U.S. Cl. ..... 62/212; 62/149; 62/227

[58] Field of Search ..... 62/126, 149, 129, 225, 62/228.1, 227

[56] References Cited

U.S. PATENT DOCUMENTS 4,106,306 8/1978 Saunders ..... 62/149
4,571,951 2/1986 Szymaszek ..... 62/225 X
4,616,485 10/1986 Gillett et al. ..... 62/228.1

FOREIGN PATENT DOCUMENTS 0075649 5/1983 Japan ..... 62/126
60-194259 10/1985 Japan .
62-8704 2/1987 Japan .

*Primary Examiner*—William E. Wayner
*Attorney, Agent, or Firm*—Cushman, Darby & Cushman

[57] ABSTRACT

A condenser is connected to an outlet of a compressor. An expansion valve is connected to the condenser. An evaporator is connected between the expansion valve and an inlet of the compressor. A sensor detects a condition of refrigerant at an outlet side of the evaporator. A variation in rate of refrigerant flow into the evaporator is detected. A control device determines a variation in the detected condition of refrigerant which occurs in response to the variation in the rate of refrigerant flow. The control device judges a quantity of refrigerant to be insufficient when the determined variation in the refrigerant condition is equal to or smaller than a reference value.

9 Claims, 8 Drawing Sheets

REFRIGERATION SYSTEM

BACKGROUND OF THE INVENTION

1. Field of the Invention

This invention relates to a refrigeration system equipped with an apparatus for detecting an insufficiency of refrigerant. This invention also relates to an apparatus for detecting insufficiency of refrigerant in a refrigeration system.

2. Description of the Prior Art

A automotive air conditioner refrigeration system have a known tendency to sometime allow refrigerant to leak out. The leakage of refrigerant finally results in an insufficiency of refrigerant. In refrigeration systems, insufficiency of refrigerant causes serious problems such as inadequate cooling cap abilities or in damage to compressors. There are various known devices for detecting an insufficiency of refrigerant in a refrigeration system.

Japanese published examined patent application No. 62-8704 discloses an apparatus for controlling the flow rate of refrigerant in refrigeration cycle. This apparatus includes a device for determining the degree of superheating of the refrigerant at the outlet of an evaporator. In general, superheating of refrigerant is caused by insufficiency of refrigerant. In the apparatus of Japanese patent application No. 62-8704, sensors detect temperatures of refrigerant at points upstream and downstream of the evaporator. The degree of superheating of refrigerant is determined in accordance with the detected temperatures of refrigerant at points upstream and downstream of the evaporator.

Devices disclosed in Japanese published unexamined utility model application No. 54-32137 and Japanese published examined patent application No. 57-38447 detect insufficiency of refrigerant in accordance with the pressure of refrigerant.

SUMMARY OF THE INVENTION

It is an object of this invention to provide a reliable refrigeration system.

It is another object of this invention to provide a reliable apparatus detecting insufficiency of refrigerant.

In a refrigeration system of this invention, a condenser is connected to an outlet of a compressor. An expansion valve is connected to the condenser. An evaporator is connected between the expansion valve and an inlet of the compressor. A sensor detects a condition of refrigerant at an outlet side of the evaporator. A control device determines a variation in the detected condition of refrigerant which occurs in response to a variation in rate of refrigerant flow. The control device judges a quantity of refrigerant to be insufficient when the determined variation in the refrigerant condition is equal to or smaller than a reference value.

In another refrigeration system of this invention, refrigerant is circulated through an evaporator. A condition of the refrigerant at an outlet side of the evaporator is monitored. A rate of refrigerant flow into the evaporator is varied. A device detects a response of the monitored condition to the variation in the refrigerant flow. A determination is made as to whether a quantity of the refrigerant is sufficient or insufficient in accordance with the detected response of the monitored condition.

In an apparatus of this invention, a condition of refrigerant at an outlet side of an evaporator is monitored. A rate of refrigerant flow into the evaportor is varied. A device detects a response of the monitored condition to the variation in the refrigerant flow. Insufficiency of refrigerant is detected in accordance with the detected response of the monitored condition.

BRIEF DESCRIPTION OF THE DRAWINGS

Like and corresponding elements are denoted by the same reference characters throughout the drawings.

DESCRIPTION OF THE FIRST PREFERRED EMBODIMENT

Figure 1:
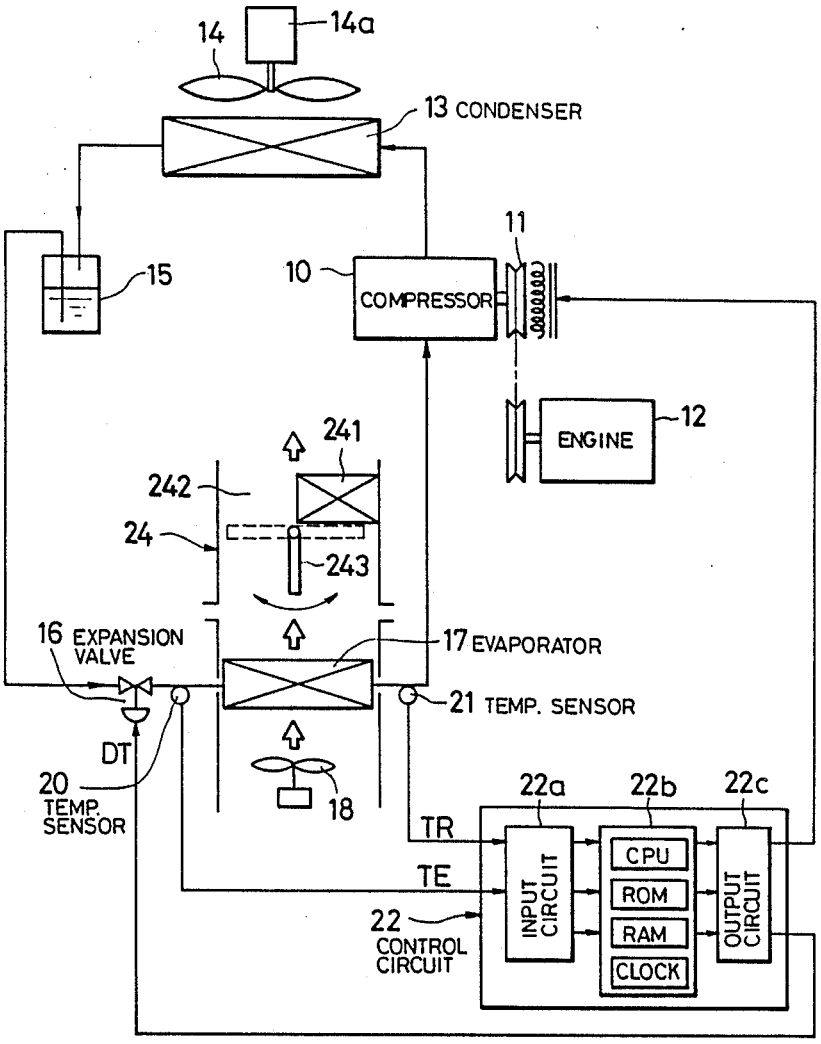
FIG. 1 is a diagram of a refrigeration system according to a first embodiment of this invention.

With reference to FIG. 1, an automotive air conditioner refrigeration system includes a compressor 10 connected via an electromagnetic clutch 11 to an automotive engine 12. The clutch 11 selectively couples and uncouples the compressor 10 to and from the engine 12 in accordance with an electric signal applied to the clutch 11. When the compressor 10 is coupled to the engine 12, the device 10 is activated or driven by the engine 12. When the compressor 10 is uncoupled from the engine 12, the device 10 is deactivated.

An outlet of the compressor 10 is connected to an inlet of a condenser 13 so that gas refrigerant moved by the compressor 10 enters the condenser 13. The condenser 13 is exposed to cooling air driven by a fan 14. The cooling air allows the device 13 to cool and condense the gas refrigerant. The cooling fan 14 is powered by a motor 14*a*.

An outlet of the condenser 13 is connected to a receiver 15 so that condensed or liquefied refrigerant moves from the condenser 13 to the receiver 15. The receiver 15 holds the liquid refrigerant. The receiver 15 is connected to an inlet of an electrically-driven expansion valve 16 so that the liquid refrigerant moves from the receiver 15 to the expansion valve 16. The degree of opening through the expansion valve 16 can be adjusted via an electric signal applied to the valve 16. Since the rate of refrigerant flow through the expansion valve 16 depends on the degree of opening through the expansion valve 16, the rate of refrigerant flow can be adjusted via the signal applied to the valve 16. The expansion valve 16 generally serves to lower the pressure and the temperature of the liquid refrigerant.

An outlet of the expansion valve 16 is connected to an inlet of an evaporator 17 so that the refrigerant moves from the expansion valve 16 to the evaporator 17. The evaporator 17 is exposed to air driven by a fan 18. The evaporator 17 transfers heat from the air to the refrigerant so that the air is cooled. During this heat transfer, the refrigerant vaporizes. The degree of cooling of the air depends on the latent heat of vaporization of the refrigerant. The cooled air moves from the evaporator 17 into a passenger compartment of an automotive vehicle via a heater unit 24.

The heater unit 24 includes a heater core 241, a passage 242 bypassing the heater core 241, and a movable damper 243. The heater core 241 is supplied with automotive engine coolant serving as a heating source. The damper 243 controls the temperature of air discharged into the vehicle passenger compartment by adjusting the ratio between the rate of air flow through the heater core 241 and the rate of air flow moving through the bypass passage 242 and thus bypassing the heater core 241.

An outlet of the evaporator 17 is connected to an inlet of the compressor 10 so that the gas refrigerant returns to the compressor 10.

A first temperature sensor 20 preferably composed of a thermistor is disposed at a point of a line or pipe connecting the outlet of the expansion valve 16 and the inlet of the evaporator 17. The first sensor 20 detects the temperature of refrigerant in a region upstream of the evaporator 17 but downstream of the expansion valve 16 This first detected temperature is therefore the temperature of refrigerant at an inlet side of the evaporator 17. The temperature of refrigerant at the inlet side of the evaporator 17 is referred to as the evaporator inlet refrigerant temperature TE. The sensor 20 generates an electric signal representing the evaporator inlet refrigerant temperature TE.

A sensing element of the first temperature sensor 20 is preferably disposed within the connection pipe so that the first sensor 20 can directly detect the refrigerant temperature. The sensing element of the first temperature sensor 20 may be closely fixed to an outer surface of the connection pipe and covered with a heat insulating member.

A second temperature sensor 21, preferably composed of a thermistor, is disposed at a point of a line or pipe connecting the outlet of the evaporator 17 and the inlet of the compressor 10. The second sensor 21 detects the temperature of refrigerant in a region downstream of the evaporator 17 but upstream of the compressor 10, that is, the temperature of refrigerant at an outlet side of the evaporator 17. The temperature of refrigerant at the outlet side of the evaporator 17 is referred to as the evaporator outlet refrigerant temperature TR. The sensor 21 generates an electric signal representing the evaporator outlet refrigerant temperature TR.

A sensing element of the second temperature sensor 21 is preferably disposed within the connection pipe so that the second sensor 21 can directly detect the refrigerant temperature. The sensing element of the second temperature sensor 21 may be closely fixed to an outer surface of the connection pipe and covered with a heat insulating member.

A control circuit 22 includes an input circuit **22*a*, a microcomputer 22*b*, and an output circuit 22*c*. The input circuit 22*a* is electrically connected to the first and second temperature sensors 20 and 21 so that the circuit 22*a* receives the signals from the sensors 20 and 21. The microcomputer 22*b* is connected between the input circuit 22*a* and the output circuit 22*c*. The microcomputer 22*b* executes preset calculations or signal processing with respect to the signals fed from the input circuit 22*a* and thereby generates secondary signals fed to the output circuit 22*c*. The output circuit 22*c* generates control signals in accordance with the secondary signals. The output circuit 22*c* is electrically connected to the clutch 11 and the expansion valve 16 so that the control signals are applied to the devices 11 and 16 respectively. The clutch 11 and the expansion valve 16 are controlled via the signals applied to the devices 11 and 16 from the output circuit 22*c***.

The signals outputted by the temperature sensors 20 and 21 are generally analog. The input circuit **22*a* therefore includes an analog-to-digital converter or converters which derive digital temperature signals from the analog temperature signals. The output circuit 22*c* includes drive circuits or relay circuits for driving the clutch 11 and the expansion valve 16**.

The microcomputer **22*b* is preferably composed of a digital computer including a single chip of a large-scale integrated circuit (LSI). The microcomputer 22*b* is powered by a constant voltage supplied from a voltage regulating circuit (not shown). When an ignition switch (not shown) associated with the engine 12** is closed or turned on, the voltage regulating circuit is activated, deriving the constant voltage from a voltage across a dc power source, such as a battery, mounted on the vehicle.

The microcomputer **22*b* includes a central processing unit (CPU), a read-only memory (ROM), a random-access memory (RAM), and a clock generator. The clock generator is connected to the CPU, the ROM, and the RAM to apply a clock signal to the CPU, the ROM, and the RAM. The CPU, the ROM, and the RAM are mutually connected via bus lines. During signal processing, the RAM temporarily holds various digital signals handled in the CPU. The microcomputer 22*b*** operates in accordance with a program stored in the ROM.

Figure 2:
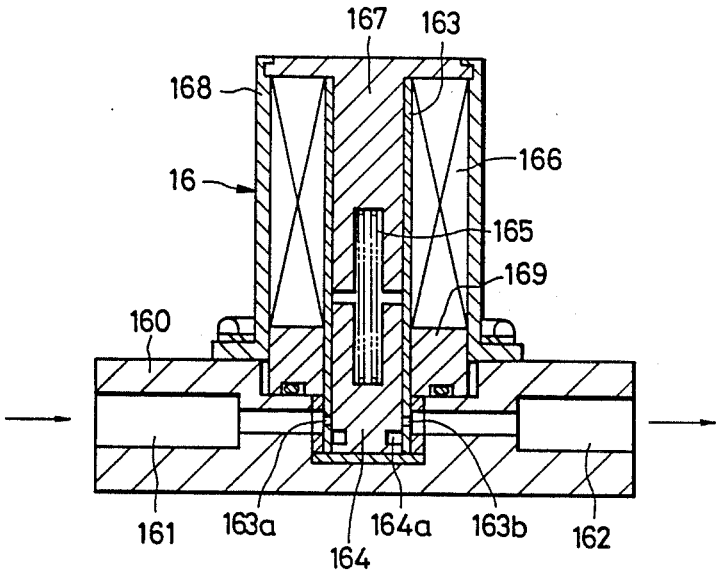
FIG. 2 is a sectional view of the expansion valve of FIG. 1.

As shown in FIG. 2, the expansion valve 16 includes a base 160 having opposite ends formed with an inlet passage 161 and an outlet passage 162 respectively. The inlet and outlet passages 161 and 162 are connected via an inner passage (no reference character). The inlet passage 161 is connected to the receiver 15 (see FIG. 1) so that the inlet passage 161 is supplied with liquid refrigerant from the receiver 15. The outlet passage 162 is connected to the inlet of the evaporator 17 (see FIG. 1) so that the refrigerant moves from the outlet passage 162 to the evaporator 17.

A tubular or cylindrical member 163 made of nonmagnetic material extends into the base 160 and has diametrically opposed valve openings **163*a* and 163*b* in communication with the inner passage connecting the inlet and outlet passages 161 and 162. A valve plunger 164 made of magnetic material is slideably disposed within the cylindrical member 163. The valve plunger 164 has a circumferential groove 164*a*. The circumferential groove 164*a* moves into and out of communication with the valve openings 163*a* and 163*b* in accordance with the position of the valve plunger 164. When the circumferential groove 164*a* moves into communication with the valve openings 163*a* and 163*b*, the inlet passage 161 and the outlet passage 162 are mutually connected so that the expansion valve 16 is opened. When the circumferential groove 164*a* moves out of communication with the valve openings 163*a* and 163*b*, the inlet passage 161 and the outlet passage 162 are disconnected from each other so that the expansion valve 16** is closed.

A winding 166 electrically connected to the control circuit 22 (see FIG. 1) extends around the cylindrical member 163. A spring 165 residing within the cylindrical member 163 is seated between the valve plunger 164 and a magnetic pole member 167 fixedly extending into the cylindrical member 163. The spring 165 urges the valve plunger 164 relative to the fixed magnetic pole member 167. When no electric current passes through the winding 166, the spring 165 holds the valve plunger 164 in its lowest position, as seen in FIG. 2, at which the circumferential groove 164*a* remains out of communication with the valve openings 163*a* and 163*b*, so that the expansion valve 16 is closed. A tubular or cylindrical yoke 168 fixed to the base 160 accommodates the cylindrical member 163 and the winding 166. An upper end of the magnetic pole member 167 is fixedly retained by the cylindrical yoke 168. A magnetic end ring 169 extends around the cylindrical member 163 in a region immediately below the winding 166. The valve plunger 164, the magnetic pole member 167, the cylindrical yoke 168, and the magnetic end ring 169 form a magnetic circuit with respect to a magnetic field generated by the winding 166. When a preset electric current passes through the winding 166, an attractive force acting between the valve plunger 164 and the fixed magnetic pole member 167 is magnetically generated so that the valve plunger 164 is attracted by and moved toward the magnetic pole member 167 against the force of the spring 165. In this way, when a preset electric current passes through the winding 166, the valve plunger 164 moves from its lowest position to its highest position, as seen in FIG. 2, at which the circumferential groove 164*a* communicates with the valve openings 163*a* and 163*b* so that the expansion valve 16 is opened.

The control signal applied to the expansion valve 16 from the control circuit 22 includes a constant frequency pulse train. During the absence of a pulse in the control signal applied to the expansion valve 16, no current flows through the winding 166 so that the expansion valve 16 is closed. During the presence of a pulse in the control signal applied to the expansion valve 16, a preset current flows through the winding 166 so that the expansion valve 16 is opened. In this way, the expansion valve 16 periodically moves between a closed state and an open state in accordance with the control pulse signal applied to the expansion valve 16. The average or effective degree of opening through the expansion valve 16 depends on the duty cycle of the control pulse signal applied to the expansion valve 16. Accordingly, the effective degree of opening through the expansion valve 16 and the rate of refrigerant flow into the evaporator 17 can be adjusted in accordance with the duty cycle of the control pulse signal applied to the expansion valve 16.

Figure 3:
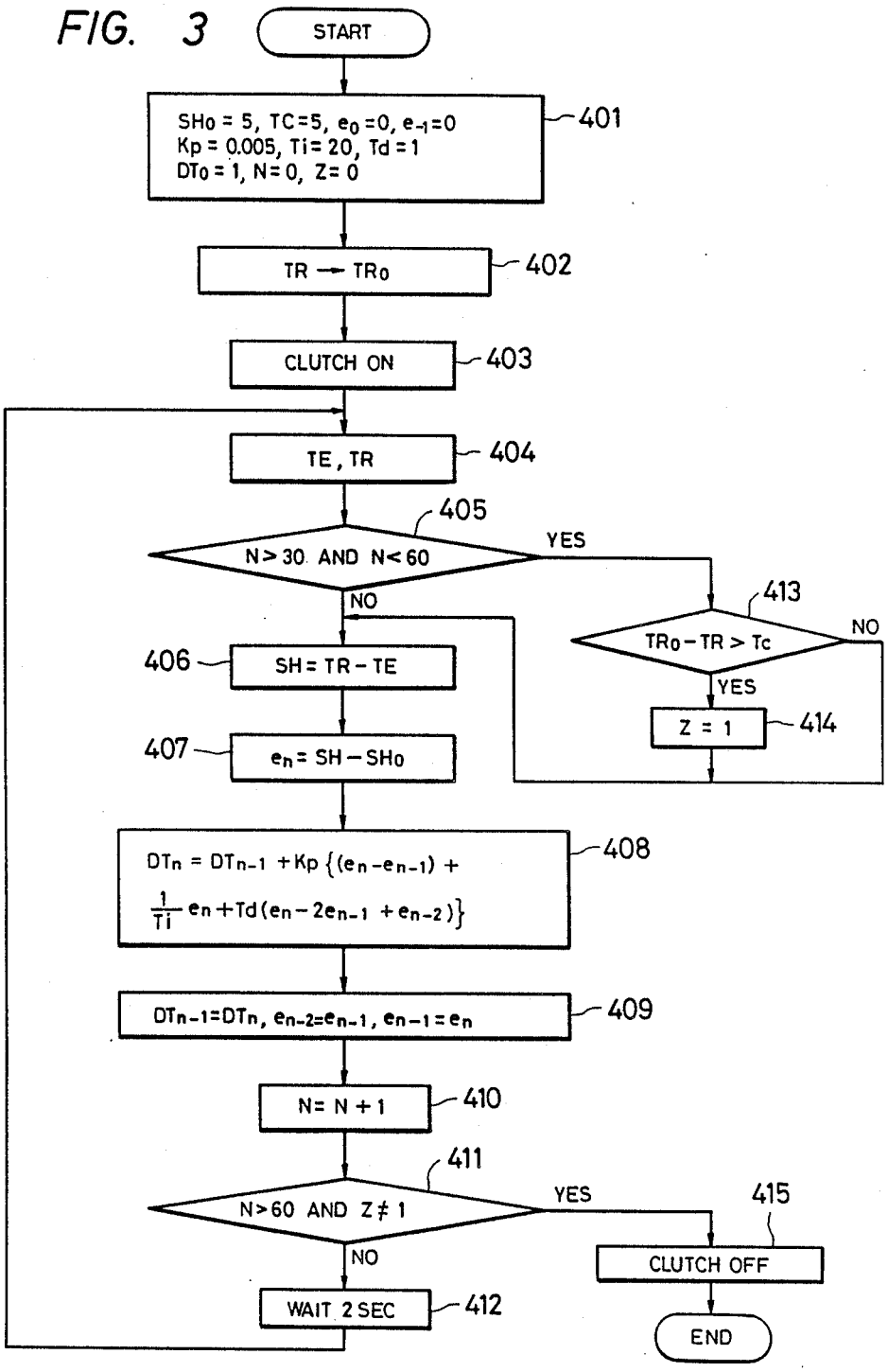
FIG. 3 is a flowchart of a program operating the control circuit of FIG. 1.

The control circuit 22 operates in accordance with a program stored in the ROM within the microcomputer 22*b*. FIG. 3 is a flowchart of this program. When an air conditioner switch (not shown) is moved to an "ON" position, the program of FIG. 3 starts.

As shown in FIG. 3, a first step 401 of the program initializes or sets a target temperature difference or refrigerant superheat degree SHO, a refrigerant insufficiency reference temperature Tc, a PID (proportional plus integral plus derivative) control proportional gain Kp, an integral time Ti, a derivative or differential time Td, an expansion valve control signal duty cycle $DT_0$, a counter value N, a decision value Z, a deviation $e_0$, and a deviation $e_{-1}$ to 5, 5, 0.005, 20, 1, 1, 0, 0, 0, and 0 respectively.

A step 402 following the step 401 derives the current value of the evaporator outlet refrigerant temperature from the signal outputted by the second temperature sensor 21. The step 402 sets the variable TRo equal to the derived current value of the evaporator outlet refrigerant temperature. The evaporator outlet refrigerant temperature TRo is stored in the RAM within the microcomputer 22*b*. As will be made clear hereinafter, this evaporator outlet refrigerant temperature TRo occurs before the compressor 10 is activated or started.

A step 403 following the step 402 changes the clutch 11 to an engaged or "ON" position via the control signal outputted to the clutch 11. When the clutch 11 is moved to its "ON" position, the compressor 10 is coupled to the engine 12 so that the compressor 10 is activated or started. After the step 403, the program advances to a step 404.

The step 404 derives the current value of the evaporator inlet refrigerant temperature from the signal outputted by the temperature sensor 20. The derived current value of the evaporator inlet refrigerant temperature is represented by the variable TE. The evaporator inlet refrigerant temperature TE is stored in the RAM within the microcomputer 22*b*. In addition, the step 404 derives the current value of the evaporator outlet refrigerant temperature from the signal outputted by the temperature sensor 21. The derived current value of the evaporator outlet refrigerant temperature is represented by the variable TR. The evaporator outlet refrigerant temperature TR is stored in the RAM within the microcomputer 22*b*. It should be noted that this evaporator outlet refrigerant temperature TR occurs after the compressor 10 is started.

A step 405 following the step 404 determines whether or not the counter value N resides between 30 and 60. As will be made clear hereinafter, the counter value N represents the time elapsed since the moment of the starting of the compressor 10, and one or unity of the counter value N corresponds to a time interval of about 2 seconds. Accordingly, the step 405 determines whether or not the time elapsed since the start of the compressor 10 resides between one minute and two minutes. When the counter value N is greater than 30 but smaller than 60, that is, the time elapsed since the start of the compressor 10 is longer than one minute but shorter than two minutes, the program advances to a step 413. When the counter value N does not reside between 30 and 60, that is, when the time elapsed since the start of the compressor 10 does not reside between one minute and two minutes, the program advances to a step 406.

The step 413 calculates a temperature difference ΔTR which equals the evaporator outlet refrigerant temperature TRo derived before the start of the compressor 10 minus the evaporator outlet refrigerant temperature TR derived after the start of the compressor 10. Then, the step 413 compares the temperature difference ΔTR with the reference temperature Tc corresponding to 5° C. When the temperature difference ΔTR is greater than the reference temperature Tc, the program advances to a step 414. When the temperature difference ΔTR is not greater than the reference temperature Tc, the program advances to the step 406.

The step 414 sets the decision value Z to one or unity. After the step 414, the program advances to the step 406.

The reference temperature Tc is chosen so that the temperature difference ΔTR will increase above the reference temperature Tc if the quantity of refrigerant is sufficient. As described previously, when the temperature difference ΔTR is greater than the reference temperature Tc, the program advances from the step 413 to the step 414 in which the decision value Z is made equal to one or unity. Accordingly, the decision value Z equal to one or unity represents that the quantity of refrigerant is sufficient. The decision value Z equal to zero can represent that the quantity of refrigerant is insufficient.

The step 406 calculates a temperature difference SH which equals the evaporator outlet refrigerant temperature TR minus the evaporator inlet refrigerant temperature TE. It should be noted that this temperature difference SH represents the degree of superheat of refrigerant.

A step 407 following the step 406 calculates a deviation $e_n$ which equals the actual temperature difference SH minus the target temperature difference SHO. After the step 407, the program advances to a step 408.

The step 408 determines or calculates a target duty cycle $DT_n$ of the control signal applied to the expansion valve 16 by referring to the following equation:

$$DT_n = DT_{n-1} + Kp[(e_n - e_{n-1}) + (e_n/Ti) + Td(e_n - 2e_{n-1} + e_{n-2})]$$

where the variables $DT_n$ and $e_n$ represent the values determined during the present execution cycle of the program; the variables $DT_{n-1}$ and $e_{n-1}$ represent the values determined during the execution cycle of the program which precedes the present execution cycle of the program; and the variable $e_{n-2}$ represents the value determined during the execution cycle of the program which precedes the execution cycle of the program immediately prior the the present execution cycle of the program. This equation is designed so as to perform PID control.

A step 409 following the step 408 updates the variables representing the duty cycle and the temperature deviations by referring to the following equations or statements:

$$DT_{n-1} = DT_n,\ e_{n-2} = e_{n-1},\ e_{n-1} = e_n$$

After the step 409, the program advances to a step 410.

The step 410 increments the counter value N by one or unity by executing the following statement:

$$N = N + 1$$

After the step 410, the program advances to a step 411.

The step 411 determines whether or not the counter value N is greater than 60 and the decision value Z equals zero, that is, whether or not the time elapsed since the start of the compressor 10 is longer than two minutes and the decision value Z equals zero. When the counter value N is greater than 60 and the decision value Z equals zero, that is, when the time elapsed since the start of the compressor 10 is longer than two minutes and the decision value Z equals zero, the program advances to a step 415. When the counter value N is not greater than 60, that is, when the time elapsed since the start of the compressor 10 is not longer than two minutes, the program advances to a step 412. When the decision value Z equals one or unity, the program also advances to the step 412.

The quantity of refrigerant is judged to be insufficient when the counter value N is greater than 60 and the decision value Z equals zero. Accordingly, when the quantity of refrigerant is judged to be insufficient, the program advances from the step 411 to the step 415.

The step 415 changes the clutch 11 to a disengated or "OFF" position via the control signal outputted to the clutch 11. When the clutch 11 is moved to its "OFF" position, the compressor 10 is uncoupled from the engine 12 so that the compressor 10 is deactivated. In this way, when the quantity of refrigerant is judged to be insufficient, the compressor 10 is deactivated. After the step 415, the execution of the program of FIG. 3 ends.

The step 412 waits for two seconds. After the step 412, the program returns to the step 404. Accordingly, the program moves from the step 412 to the step 404 at a moment two second after the movement of the program from the step 411 to the step 412.

While the quantity of refrigerant remains sufficient, the steps 404–412 are periodically reiterated and the target duty cycle of the control signal outputted to the expansion valve 16 is periodically updated.

Figure 4:
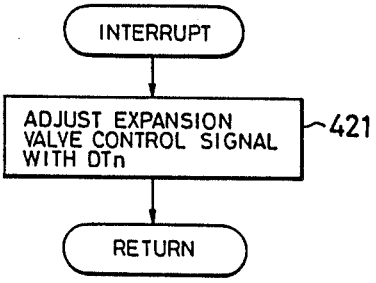
FIG. 4 is a flowchart of an interruption routine controlling the expansion valve of FIGS. 1 and 2.

The actual duty cycle of the control signal outputted to the expansion valve 16 is adjusted in accordance with the targed duty cycle $DT_n$ by a periodically-reiterated interruption routine whose flowchart is shown in FIG. 4.

As shown in FIG. 4, when the interruption routine is started, a step 421 is executed. The step 421 adjusts the actual duty cycle of the control signal to the expansion valve 16 in accordance with the target duty cycle $DT_n$ so that the actual duty cycle can be equal to the target duty cycly $DT_n$. After the step 421, the present execution of the interruption routine ends and the program returns to the main routine.

Figure 5:
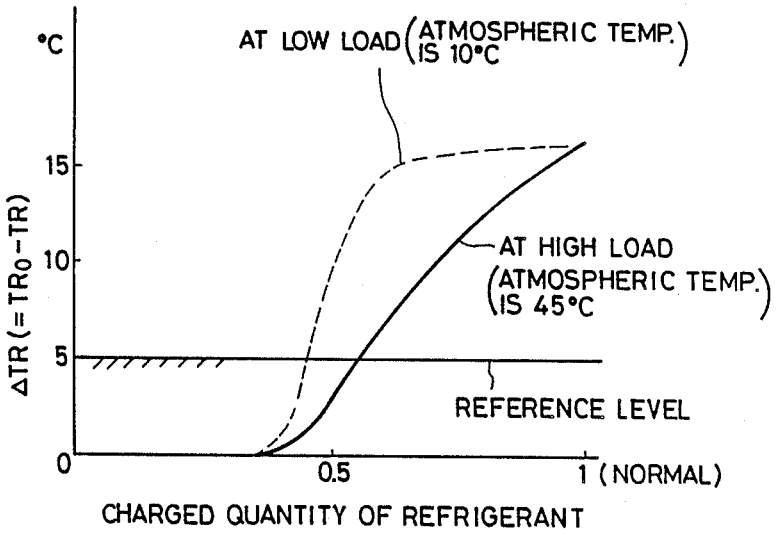
FIG. 5 is a graph showing the relationship between the temperature difference calculated in the program of FIG. 3 and the charged quantity of refrigerant at different atmospheric temperatures.

FIG. 5 shows experimental results of the relationship between the temperature difference ΔTR and the charged quantity of refrigerant at different conditions. In FIG. 5, the broken curve denotes the relationship between the temperature difference ΔTR and the charged quantity of refrigerant at an atmospheric temperature of 10° C. corresponding to a low load on the refrigeration system. The solid curve denotes the relationship between the temperature difference ΔTR and the charged quantity of refrigerant at an atmospheric temperature of 45° C. corresponding to a high load on the refrigeration system.

As shown in FIG. 5, when the charged quantity of refrigerant decreases from its nomal value to an half of the normal value, the temperature difference ΔTR decreases remarkably. Accordingly, in cases where the reference temperature Tc corresponds to a value at or around 5° C., insufficiency of the refrigerant can be reliably detected by comparing the temperature difference ΔTR with the reference temperature Tc.

It should be noted that this invention can be applied to a refrigeration system including a conventional temperature-responsive expansion valve. In this case, a sensor monitoring the temperature of refrigerant at an outlet side of the expansion valve is added to the refrigeration system in order to detect insufficiency of refrigerant. In addition, this invention can be applied to a refrigeration system including a variable-capacity type compressor. Furthermore, this invention can be applied to various refrigeration systems other than automotive air conditioner refrigeration systems.

Modifications may be made to the embodiment of FIGS. 1–5. For example, when insufficiency of refrigerant is detected, an indicator such as a light may be activated simultaneously with the deactivation of the compressor 10. In addition, the reference temperature Tc may be increased as the atmospheric temperature rises. In this case, as understood from FIG. 5, insufficiency of refrigerant can be detected more reliably at high atmospheric temperatures corresponding to high loads on the refrigeration system. Furthermore, the microcomputer **22*b*** may be replaced by a combination of discrete electric circuits.

DESCRIPTION OF THE SECOND PREFERRED EMBODIMENT

Figure 6:
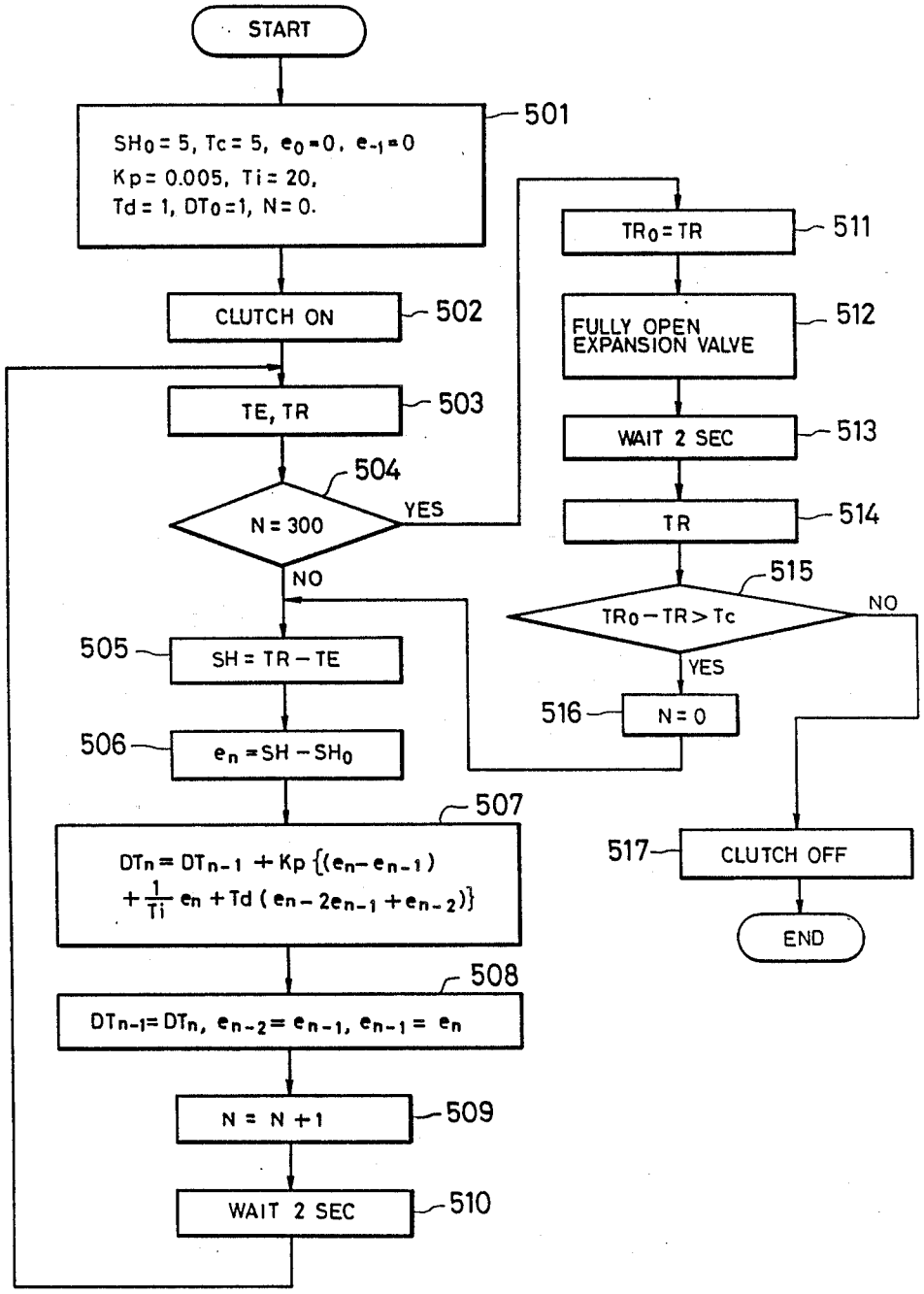
FIG. 6 is a flowchart of a program operating a control circuit in a second embodiment of this invention.

A second embodiment of this invention is similar to the embodiment of FIGS. 1–5 except for design changes described hereinafter. FIG. 6 is a flowchart of a program operating a control circuit 22 (see FIG. 1) in the second embodiment.

As shown in FIG. 6, a first step 501 of the program performs initialization as in the step 401 of FIG. 3.

A step 502 following the step 501 changes the clutch 11 (see FIG. 1) to an "ON" position as in the step 403 of FIG. 3, so that the compressor 10 (see FIG. 1) starts. After the step 502, the program advances to a step 503.

The step 503 derives or detects the current evaporator inlet refrigerant temperature TE and the current evaporator outlet refrigerant temperature TR as in the step 404 of FIG. 3.

A step 504 following the step 503 determines whether or not the counter value N equals 300, that is, whether or not the time elapsed since the start of the compressor 11 equals ten minutes. When the counter value N equals 300, that is, when the time elapsed equals ten minutes, the program advances to a step 511. When the counter value N does not equal 300, that is, when the time elapsed does not equal ten minutes, the program advances to a step 505.

The step 511 makes the variable TRo equal to the evaporator outlet refrigerant temperature TR derived in the previous step 503.

A step 512 following the step 511 sets the target duty cycle $DT_n$ equal to one or unity, so that the expansion valve 16 (see FIG. 1) is fully opened.

A step 513 following the step 512 waits for two seconds as in the step 412 of FIG. 3.

A step 514 following the step 513 derives or detects the current evaporator outlet refrigerant temperature and thereby updates the evaporator outlet refrigerant temperature TR.

A step 515 following the step 514 calculates a temperature difference ΔTR which equals the evaporator outlet refrigerant temperature TRo derived before the fully opening or unblocking of the expansion valve 16 minus the evaporator outlet refrigerant temperature TR derived after the fully opening or unblocking of the expansion valve 16. Then, the step 515 compares the temperature difference ΔTR with the reference temperature Tc corresponding to 5° C. When the temperature difference ΔTR is greater than the reference temperature Tc, the program advances to a step 516. When the temperature difference ΔTR is not greater than the reference temperature Tc, the program advances to a step 517.

The step 517 changes the clutch 11 to an "OFF" position as in the step 415 of FIG. 3, so that the compressor 10 is deactivated.

The reference temperature Tc is chosen so that the temperature difference ΔTR will not exceed the reference temperature Tc if the quantity of refrigerant is insufficient. As described previously, when the temperature difference ΔTR is not greater than the reference temperature Tc, that is, when the quantity of refrigerant is judged to be insufficient, the program advances from the step 515 to the step 517 by which the compressor 10 is deactivated.

The step 516 clears or sets the counter value N to zero. After the step 516, the program advances to the step 505.

The step 505 calculates the temperature difference SH which equals the evaporator outlet refrigerant temperature TR minus the evaporator inlet refrigerant temperature TE.

A step 506 following the step 505 calculates the deviation $e_n$ which equals the actual temperature difference SH minus the target temperature difference SHO. After the step 506, the program advances to a step 507.

The step 507 determines or calculates the target duty cycle $DT_n$ in accordance with the deviations as in the step 408 of FIG. 3.

A step 508 following the step 507 updates the variables representing the duty cycle and the temperature deviations as in the step 409 of FIG. 3.

A step 509 following the step 508 increments the counter value N as in the step 410 of FIG. 3.

A step 510 following the step 509 waits for two seconds as in the step 412 of FIG. 3. After the step 510, the program returns to the step 503.

As understood from the previous description, in the second embodiment of this invention, the expansion valve 16 is periodically and forcedly moved to its fully open position while the compressor 10 is operating. Insufficiency of refrigerant is detected on the basis of a response or variation of the evaporator outlet refrigerant temperature with respect to this fully opening or unblocking of the expansion valve 16. Specifically, insufficiency of refrigerant is detected in accordance with a difference between the evaporator outlet refrigerant temperatures which occur before and after the fully opening or unblocking of the expansion valve 16 respectively. Since this temperature difference sensitively decreases as the quantity of refrigerant decreases, the second embodiment allows reliable detection of insufficiency of refrigerant.

Various modifications may be made to the second embodiment of this invention. For example, the expansion valve 16 may be periodically and forcedly moved to its fully closed position during activation of the compressor 10. In this case, insufficiency of refrigerant can be detected on the basis of a variation of the evaporator outlet refrigerant temperature with respect to the fully closing or blocking of the expansion valve 16.

Furthermore, the expansion valve 16 may be periodically and forcedly moved in gradual motion during activation of the compressor 10. In this case, insufficiency of refrigerant can be detected on the basis of a variation of the evaporator outlet refrigerant temperature with respect to the gradual movement of the expansion valve 16. In these modifications, it is preferable that the quantity of refrigerant is judged to be insufficient when the variation in the evaporator outlet refrigerant temperature with respect to the forced change of the degree of opening through the expansion valve 16 remains equal to or smaller than a reference value.

DESCRIPTION OF THE THIRD PREFERRED EMBODIMENT

Figure 7:
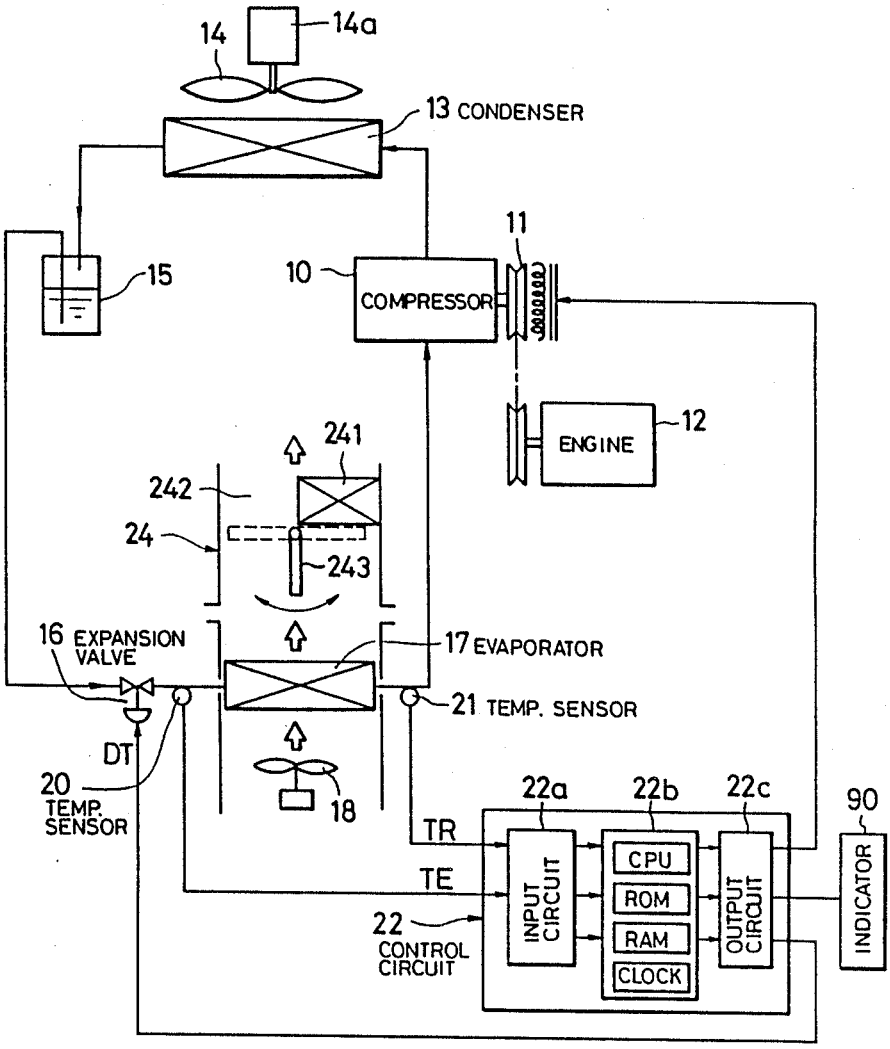
FIG. 7 is a diagram of a refrigeration system according to a third embodiment of this invention.

FIG. 7 shows a third embodiment of this invention which is similar to the embodiment of FIGS. 1-5 except for design changes described hereinafter.

As shown in FIG. 7, the third embodiment of this invention includes an indicator 90 electrically connected to the output circuit 22c within the control circuit 22. The indicator 90 is selectively activated and deactivated in accordance with a control signal outputted to the indicator 90 from the control circuit 22.

Figure 8:
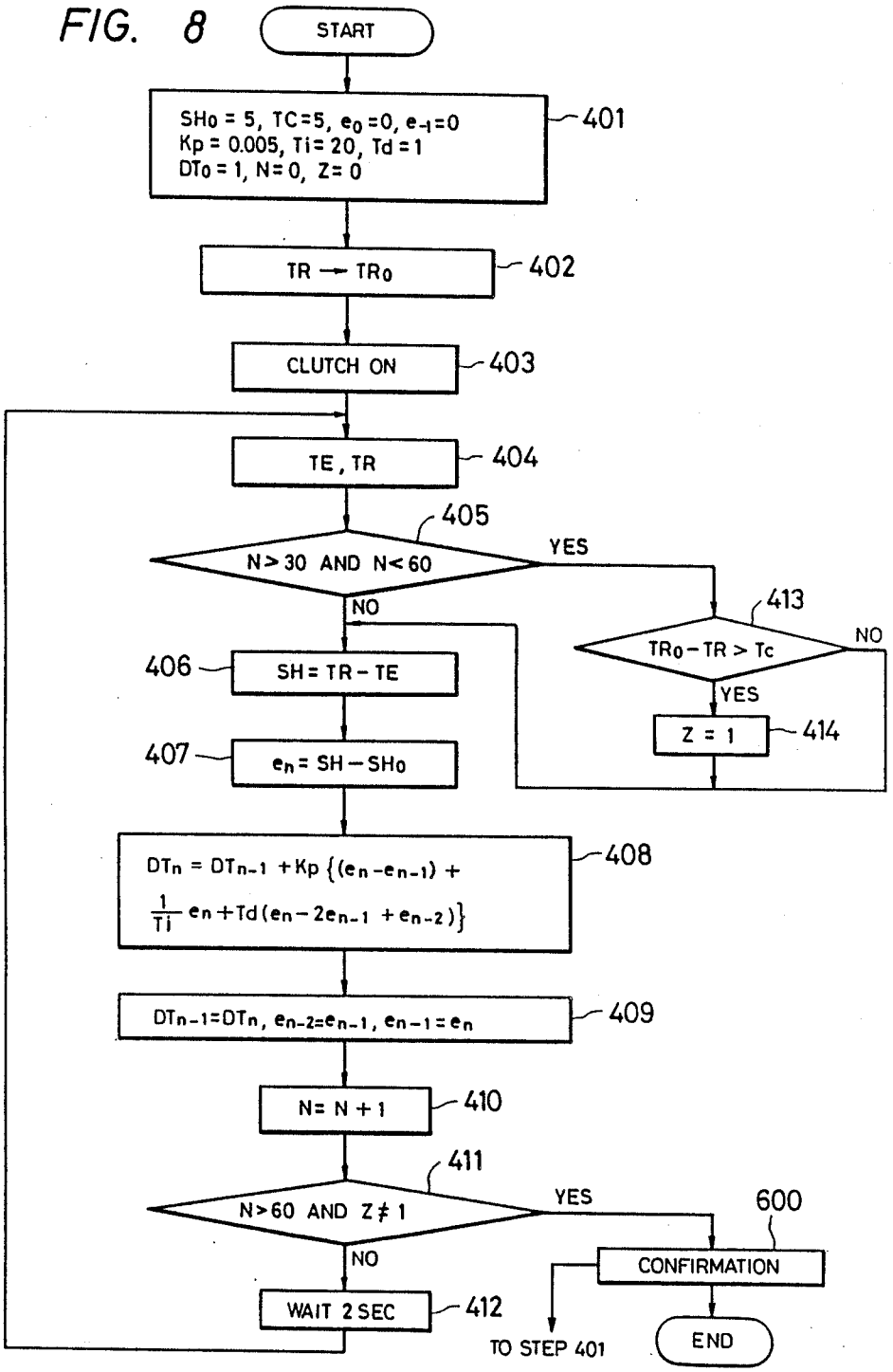
FIG. 8 is a flowchart of a program operating the control circuit of FIG. 7.
Figure 9:
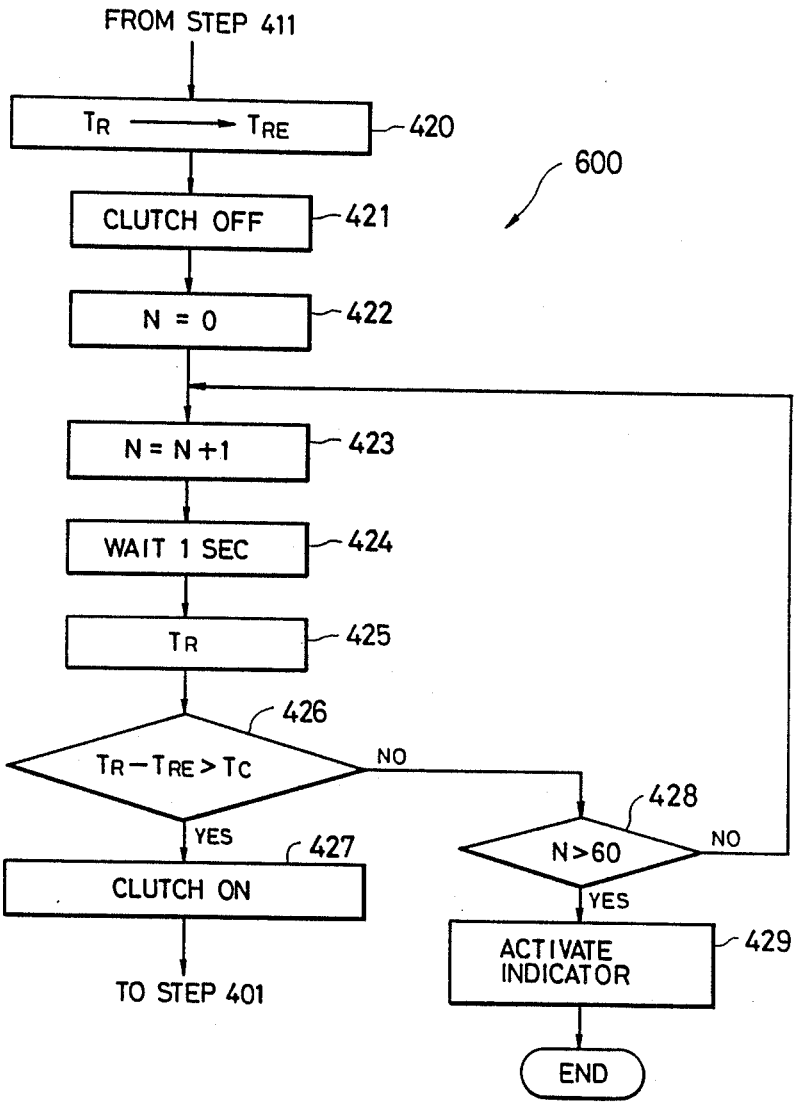
FIG. 9 is a diagram of an internal design of the confirmation block in FIG. 8.

FIG. 8 is a flowchart of a program operating the control circuit 22 in the third embodiment. The program of FIG. 8 is similar to the program of FIG. 3 except that a block 600 replaces the step 415 of FIG. 3. As will be made clear hereinafter, the block 600 is designed to confirm or make sure of insufficiency of refrigerant which was detected in the step 411. FIG. 9 shows an internal design of the confirmation block 600.

As shown in FIG. 9, the confirmation block 600 includes a step 420 following the step 411 (see FIG. 8). The step 420 detects or derives the current evaporator outlet refrigerant temperature and sets the variable TRE equal to this current evaporator outlet refrigerant temperature.

A step 421 following the step 420 moves the clutch 11 (see FIG. 1) to its "OFF" position, so that the compressor 10 (see FIG. 1) is deactivated.

A step 422 following the step 421 clears or sets the counter value N to zero. After the step 422, the program advances to a step 423.

The step 423 increments the counter value N as in the step 410 of FIG. 3.

A step 424 following the step 423 waits for one second. After the step 424, the program advances to a step 425. Accordingly, the program moves from the step 424 to the step 425 at a moment one second after the movement of the program from the step 423 to the step 424.

The step 425 detects or derives the current evaporator outlet refrigerant temperature and thereby updates the evaporator outlet refrigerant temperature TR. After the step 425, the program advances to a step 426.

The step 426 calculates a temperature difference which equals the evaporator outlet refrigerant temperature TR given in the step 425 minus the evaporator outlet refrigerant temperature TRE given in the step 420. Then, the step 426 compares this temperature difference with the reference temperature Tc. When this temperature difference exceeds the reference temperature Tc, the program advances to a step 427. When this temperature difference does not exceed the reference temperature Tc, the program advances to a step 428.

The step 427 returns the clutch 11 to its "ON" position, so that the compressor 10 restarts. After step 427, the program returns to the step 401 (see FIG. 8).

The step 428 determines whether or not the counter value N is greater than 60, that is, whether or not the time elapsed since the movement of the clutch 11 into its "OFF" position is longer than 60 seconds. When the counter value N is greater than 60, that is, when the time elapsed is longer than 60 seconds, the program advances to a step 429. When the counter value N is not greater than 60, that is, when the time elapsed is not longer than 60 seconds, the program returns to the step 423.

The step 429 activates the indicator 90 (see FIG. 7) via the control signal outputted to the indicator 90. After the step 429, the execution of the program ends. As a result, in cases where the program advances to the step 429, the clutch 11 continues to be in its "OFF" position and thus the compressor 10 remains deactivated.

As understood from the previous description, the step 420 derives the evaporation outlet refrigerant temperature TRE which occurs during the activation of the compressor 10, that is, which occurs before the deactivation of the compressor 10 by the following step 421. The step 425 derives the evaporation outlet refrigerant temperature TR which occurs after the deactivation of the compressor 10 by the previous step 421. The step 426 calculates the difference between these two temperatures TRE and TR and compares the temperature difference with the reference temperature Tc. The operation of the step 426 is to confirm or make sure that insufficiency of refrigerant occurs actually. Generally, the difference between the temperatures TRE and TR will increase above the reference temperature Tc when the quantity of refrigerant is actually sufficient. When the difference between the temperatures TRE and TR exceeds the reference temperature Tc, that is, when the quantity of refrigerant is judged to be sufficient during the confirmation process, the step 427 restarts the compressor 10. When the quantity of refrigerant is judged to be insufficient again during the confirmation process, the compressor 10 keeps deactivated and the indicator 90 is activated to inform insufficiency of refrigerant.

The third embodiment of this invention allows accurate and reliable detection of insufficiency of refrigerant. Specifically, in the third embodiment, insufficiency of refrigerant can be accurately detected independent of variations in the atmospheric temperature. Furthermore, insufficiency of refrigerant can be accurately detected in cases where the compressor 10 is activated shortly after the compressor 10 is deactivated.

Various modifications may be made to the third embodiment of this invention. For example, the quantity of refrigerant may be judged to be insufficient in cases where the superheat degree of refrigerant remains corresponding to temperatures above a reference temperature during an interval longer than a reference interval. In this modification, the confirmation process preferably makes sure of insufficiency of refrigerant by deactivating the compressor 10 and then comparing the resulting refrigerant temperature variation with a reference temperature. In a second modification, the compressor 10 is deactivated under conditions where the expansion valve 16 is fully closed or opened, and insufficiency of refrigerant is detected in accordance with a variation in the refrigerant temperature caused by the deactivation of the compressor 10. A third modication includes a sensor detecting the temperature of air which passed through the evaporator 17. In the third modification, the quantity of refrigerant is judged to be insufficient in cases where the detected air temperature remains higher than a reference temperature during an interval longer than a reference interval. The second and third modifications preferably perform the confirmation process which makes sure of insufficiency of refrigerant.

What is claimed is:

1. A refrigeration system comprising:

(a) a compressor for compressing a gas refrigerant and supplying a compressed gas refrigerant at an outlet side;

(b) a condenser connected to said outlet side of the compressor for condensing said compressed gas refrigerant from said compressor into liquid refrigerant;

(c) a decompression device connected to a downstream side of the condenser, for decompressing and expanding said liquid refrigerant from the condenser;

(d) an evaporator connected between a downstream side of the decompression device and an inlet side of the compressor for evaporating refrigerant from the decompression device;

(e) temperature sensing means for sensing a temperature of refrigerant at an outlet side of the evaporator; and (f) control means, coupled to said temperature sensing means to receive a refrigerant temperature detection signal of the temperature sensing means, for obtaining temperature of refrigerant at the outlet side of the evaporator which occur before and after a start of the compressor and calculating a different between said temperatures, and for judging an amount of the refrigerant to be insufficient when the temperature difference is less than or equal to a predetermined value; and erroneous judgement detection means for receiving the refrigerant temperature detection signal from the temperature sensing means when the control means judges the amount of refrigerant to be insufficient, detecting a difference between the temperatures of refrigerant at the outlet side of the evaporator which occur before and after the suspension of the compressor, judging the judgement by the control means to be erroneous when the temperature difference is equal to or greater than a predetermined value, and judging the judgement by the control means to be correct when the temperature difference is smaller than the predetermined value.

2. The refrigeration system of claim 1 further comprising means for restarting the compressor when the erroneous judgment detection means determines that the judgment by the control means is erroneous.

3. A refrigeration system comprising:

(a) a compressor for compressing a gas refrigerant and supplying compressed gas refrigerant at an outlet side thereof;

(b) a condenser connected to said outlet side of the compressor for condensing said compressed gas refrigerant;

(c) a decompression device connected to a downstream side of the condenser for decompressing and expanding liquid refrigerant from the condenser;

(d) an evaporator connected between a downstream side of the decompression device and an inlet side of the compressor for evaporating liquid refrigerant which has passed through the decompression device;

(e) control means for detecting an abnormal operation condition of a refrigeration cycle and suspending operation of the compressor in response to said detecting;

(f) a temperature sensing means for sensing a temperature of refrigerant at an outlet side of the evaporator; and (g) erroneous judgment detection means for receiving a refrigerant temperature detection signal from the temperature sensing means when the control means suspends the operation of the compressor, detecting a difference between the temperatures of refrigerant at the outlet side of the evaporator which occur before and after the suspension of the compressor, determining the judgment by the control means to be erroneous when the temperature difference is equal to or greater than the predetermined value.

4. The refrigeration system of claim 3 wherein the control means includes means for receiving the refrigerant temperature detection signal of the temperature sensing means, calculating the difference between the temperatures of refrigerant at the outlet side of the evaporator which occur before and after a start of the compressor, and judging a quantity of refrigerant to be insufficient when the temperature difference is less than or equal to a predetermined value.

5. The refrigeration system of claim 3 wherein the decompression device includes an electric type expansion valve electrically controlling a degree of valve opening.

6. The refrigeration system of claim 3 wherein the control means includes means for controlling a degree of valve opening of the electric type expansion valve in accordance with the temperature of refrigerant at the outlet side of the evaporator as detected by the temperature sensing means.

7. The refrigeration system of claim 6 further comprising second temperature sensing means for sensing a temperature of refrigerant at an inlet side of the evaporator, and wherein the control means includes means for calculating a difference between the refrigerant temperatures sensed by the two temperature sensing means and for controlling the degree of valve opening of the electric type expansion valve in accordance with the calculated temperature difference.

8. A refrigeration system comprising:

(a) a compressor for compressing a gas refrigerant and supplying a compressed gas refrigerant at an outlet side;

(b) a condenser connected to said outlet side of the compressor for condensing said compressed gas refrigerant from said compressor into liquid refrigerant;

(c) a decompression device connected to a downstream side of the condenser, for decompressing and expanding said liquid refrigerant from the condenser;

(d) an evaporator connected between a downstream side of the decompression device and an inlet side of the compressor for evaporating refrigerant from the decompression device;

(e) temperature sensing means for sensing a temperature of refrigerant at an outlet side of the evaporator; and (f) control means, coupled to said temperature sensing means to receive a refrigerant temperature detection signal of the temperature sensing means, for obtaining temperatures of refrigerant at the outlet side of the evaporator which occur before and after a start of the compressor and calculating a different between said temperature, and for judging an amount of the refrigerant to be insufficient when the temperature difference is less than or equal to a predetermined value wherein said control means includes means for monitoring said change in loading of said compressor by detecting a starting of said compressor.

9. A refrigeration system comprising:

(a) a compressor for compressing a gas refrigerant and supplying a compressed gas refrigerant at an outlet side;

(b) a condenser connected to said outlet side of the compressor for condensing said compressed gas refrigerant from said compressor into liquid refrigerant;

(c) a decompression device connected to a downstream side of the condenser, for decompressing and expanding said liquid refrigerant from the condenser;

(d) an evaporator connected between a downstream side of the decompression device and an inlet side of the compressor for evaporating refrigerant from the decompression device;

(e) temperature sensing means for sensing a temperature of refrigerant at an outlet side of the evaporator; and (f) control means, coupled to said temperature sensing means to receive a refrigerant temperature detection signal of the temperature sensing means, for obtaining temperatures of refrigerant at the outlet side of the evaporator which occur before and after a start of the compressor and calculating a different between said temperature, and for judging an amount of the refrigerant to be insufficient when the temperature difference is less than or equal to a predetermined value, further comprising erroneous judgement detection means for receiving the refrigerant temperature signal from the temperature sensing means when said amount of refrigerant is judged to be insufficient, and for detecting a difference between temperatures of refrigerant at the outlet side of the evaporator which occur before and after said suspension of said compressor, and for determining the judgement by said control means to be erroneous when the temperature difference is equal to or greater than a predetermined value, and judging the judgment by said control means to be correct when the temperature difference is smaller than the predetermined value.

* * * * *